United States Patent [19]

Kelsey

[11] 4,454,041

[45] Jun. 12, 1984

[54] APPARATUS FOR THE SEPARATION OF PARTICLES FROM A SLURRY

[76] Inventor: Christopher G. Kelsey, 2/83 Albert St., Hornsby, Sydney, NSW 2077, Australia

[21] Appl. No.: 438,856

[22] PCT Filed: Feb. 19, 1982

[86] PCT No.: PCT/AU82/00015

§ 371 Date: Oct. 22, 1982

§ 102(e) Date: Oct. 22, 1982

[87] PCT Pub. No.: WO82/02842

PCT Pub. Date: Sep. 2, 1982

[30] Foreign Application Priority Data

| | | | |
|---|---|---|---|
| Feb. 23, 1981 | [AU] | Australia | PE7704 |
| Nov. 19, 1981 | [AU] | Australia | PF1621 |
| Nov. 20, 1981 | [AU] | Australia | PF1639 |

[51] Int. Cl.[3] ..... B04B 5/02

[52] U.S. Cl. ..... 210/235; 494/33; 494/37; 210/370

[58] Field of Search ..... 210/325, 370; 233/25; 241/DIG. 27; 259/DIG. 46

[56] References Cited

U.S. PATENT DOCUMENTS

| | | | |
|---|---|---|---|
| 1,665,065 | 4/1928 | Malloy | 210/325 |
| 1,861,878 | 6/1932 | Quiroz | 210/325 |
| 2,546,427 | 3/1951 | Bullen | 210/325 |
| 2,822,127 | 2/1958 | Sinn | 233/2 |
| 3,292,350 | 12/1966 | Tasset | 210/325 |
| 3,627,138 | 12/1971 | Peck | 210/325 |

FOREIGN PATENT DOCUMENTS

| | | |
|---|---|---|
| 109598 | 2/1940 | Australia . |
| 41513 | 11/1978 | Australia . |
| 272047 | 6/1927 | United Kingdom . |
| 1218468 | 1/1971 | United Kingdom . |
| 2013098 | 8/1979 | United Kingdom . |

*Primary Examiner*—Frank Sever

*Attorney, Agent, or Firm*—Burns, Doane, Swecker and Mathis

[57] ABSTRACT

Fine particles such as minerals in a slurry are separated according to their specific gravity by cyclic centrifugal acceleration preduced by rotating a chamber (40) about its own axis and a further axis. Particles of greatest specific gravity are removed from the chamber (40) in the region of its side wall most remote from the further axis.

13 Claims, 8 Drawing Figures

APPARATUS FOR THE SEPARATION OF PARTICLES FROM A SLURRY

FIELD OF THE INVENTION

This invention relates to the mechanical separation of materials of different specific gravity, and is of particular application to the separation of minerals.

BACKGROUND ART

The mechanical separation of mineral particles according to their specific gravity is achieved in a variety of ways including the process of jigging. In a conventional jig, particles in a thick suspension in a slurry are repeatedly allowed to fall, stratifying the particles into layers which are then removed.

The efficient operation of such equipment requires sizing of the feed product, and particles of small size which inevitably are produced in crushing and milling, cannot be recovered by normal processing. Such smaller particles in wet processing become what is termed "slimes", and the forces available to shear these particles from the viscous fluid and to separate them from large particles of lower specific gravity are, in prior art processes, inadequate.

An essential characteristic of the jigging process is repetitive acceleration of the particles, separation occurring due to the fact that the heavy particles have a greater initial acceleration and speed than the light particles. In the case of small particles furthermore, these must have sufficient acceleration also to overcome fluid resistance, which is of great significance in the case of particles having a large surface area, for example gold particles which have been flattened in the grinding process.

DISCLOSURE OF THE INVENTION

The present invention is directed to the provision of apparatus and methods whereby separation of such smaller particles can be achieved in an efficient manner. In accordance with the invention, repetitive acceleration of the particles is achieved by the cyclic generation of centrifugal force. In this way not only is the necessary repetitive acceleration achieved, but also forces many times that of gravity may be employed, enabling the separation of small particles from the fluid and the rapid separation of particles according to their specific gravity.

The use of centrifugal force for the separation of solids from a fluid is of course well known. In the present invention, however, centrifugal force is combined with jigging to achieve separation of particles of high specific gravity. As will be explained below, the process of separation which results is quite different from that which is achieved by conventional centrifuging, and far superior to that obtained by means of a conventional jig.

DESCRIPTION OF PREFERRED EMBODIMENTS

Figure 1:
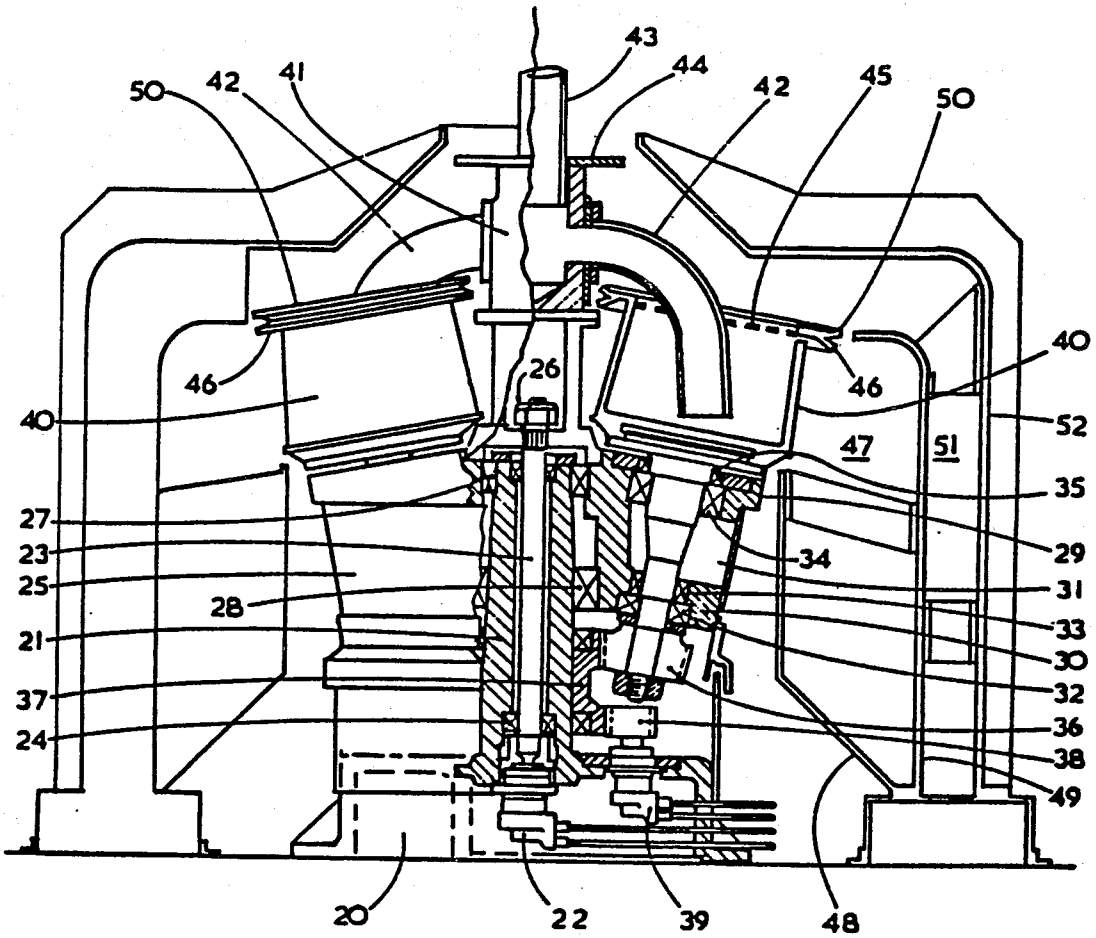
FIG. 1 is a partly sectioned side elevation of a jig embodying the present invention.
Figure 2:
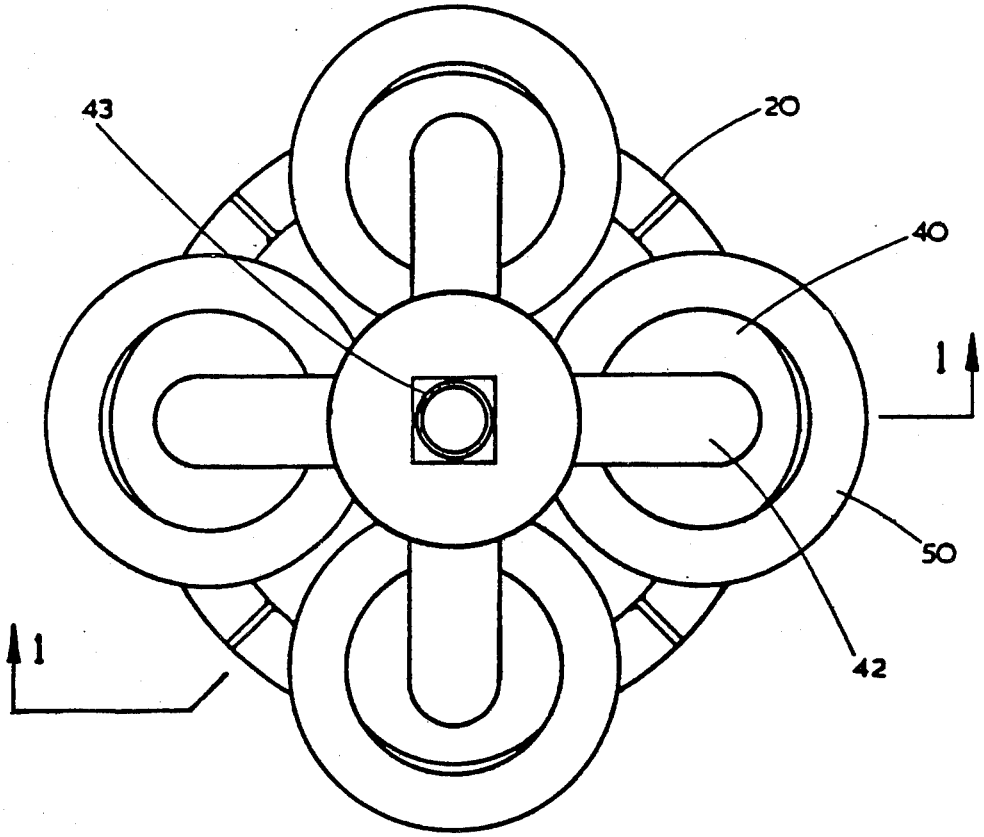
FIG. 2 is a plan view of the embodiment, with the separation guards removed.

The illustrated apparatus comprises a base 20 which is provided with an integral central column 21. Mounted centrally within the base 20 is an hydraulic motor 22 the shaft of which is connected to a vertical driving shaft 23 mounted within the column 21 by means of bearings 24.

Mounted on the upper end of the shaft 23, beyond the column 21, is a main frame member 25. This member is mounted to the shaft by means of splines and a nut 26, and revolves about the column 21 on which it is supported by bearings 27 and 28.

Figure 3:
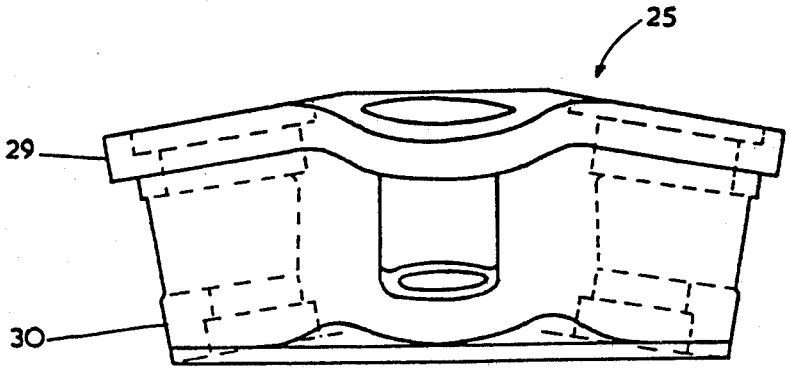
FIG. 3 is an elevation of the main frame member of the jig of FIGS. 1 and 2.
Figure 4:
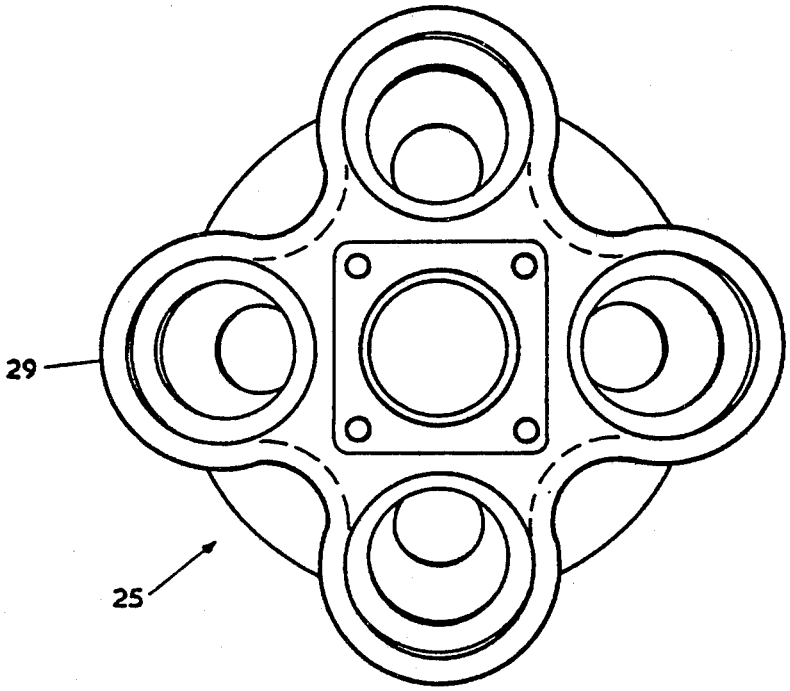
FIG. 4 is a plan view of the main frame member.

Extending from the central portion of the frame member 25 are upper and lower flanges 29 and 30 respectively. As shown particularly in FIGS. 3 and 4, these flanges are shaped to provide for equally circumferentially spaced lobes, and provide for the mounting of bucket shafts 31. In the lower flange there are provided thrust bearings 32 and spherical roller bearings 33, while in the upper flange the bucket shaft 31 is located by means of roller bearing 34, and the upper portion of the shaft 31 is surrounded by a seal 35.

Each bucket shaft 31 extends below the frame 25 and is provided with a pinion gear 36 which meshes with a gear 37 mounted for rotation about the column 21. The gear 37 is driven by drive pinion 38 which is mounted on the shaft of a further hydraulic motor 39 mounted on the base 20.

In this way buckets 40 may be rotated about the central axis of the apparatus at a speed controlled by the hydraulic motor 22, while the buckets are rotated on their own axes at a speed independently controlled by the hydraulic motor 39.

Mounted above the main frame member 25 and rotating with that member is a slurry inlet member 41, which is provided with feed pipes 42 which extend outwardly and downwardly into respective drums 40. Into the open upper end of the slurry inlet member 41 there projects a fixed feed pipe 43. Surrounding the upper end of the member 41 is a disc 44 which serves to fling slurry which may spill from the member 41, outwardly and away from the rotating machinery.

In this way, slurry may be fed continuously to the four buckets as they rotate, feed of slurry through the pipes 42 being assisted by centrifugal action. The pipes 42 extend well into the buckets 40 so that incoming slurry achieves the desired residence time in the bucket. Somewhat below its upper edge, each bucket is provided with a line of slots 45 through which material of high specific gravity, which collects adjacent the bucket wall as described below, may pass. Upon exit from the slots 45, this material is guided by a downwardly sloping flange 46 into a chamber 47 which is provided between inner walls 48 and 49 of a surrounding separation and guard structure.

The remaining material is ejected from the buckets 40 and, guided by a flange 50, passes to a chamber 51 between the inner wall 49 and the outer wall 52 of the separation and guard structure. It will be appreciated that chambers 47 and 51 are provided with outlet pipes, not shown.

To describe the action of this centrifugal jig reference will now be made to FIGS. 5 to 8. The rate of migration v of a particle of radius r and specific gravity D in a fluid of specific gravity d and viscosity n, in a centrifuge rotating at S rpm is:

$$v = \frac{\pi^2 S^2 R(D-d)r^2}{4050n}$$

at a distance R from the axis of the centrifuge, in c.g.s. units. Thus the migration rate is proportional to the square of the radius of the particle.

Figure 5:
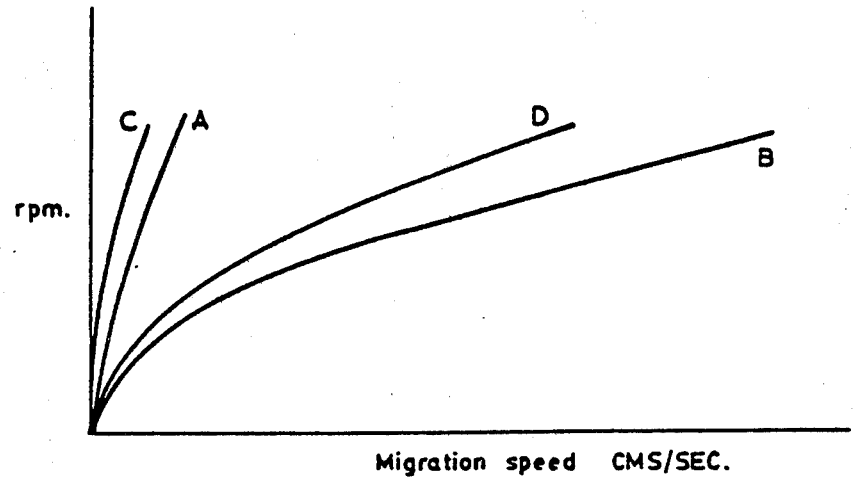
FIG. 5 shows curves of particle migration speed in a centrifuge.

The graph of FIG. 5 shows the effect of particle size and density on migration speed in a centrifuge, for the case of particles of specific gravity 19 and diameters of 50 and 100 microns (curves A and B respectively) and particles of specific gravity 2.8 with diameters of 100 and 300 microns (curves C and D respectively), these specific gravities (and the other parameters used in the generation of the curves of FIG. 5) being typical of those encountered in gold extraction.

It will be observed that the larger, less dense particles migrate faster than the smaller dense particles, so that while the small particles can at least be moved in the fluid due to the large forces generated by the centrifuge, they will not report in the desired order at the outer region of the centrifuge.

Figure 6:
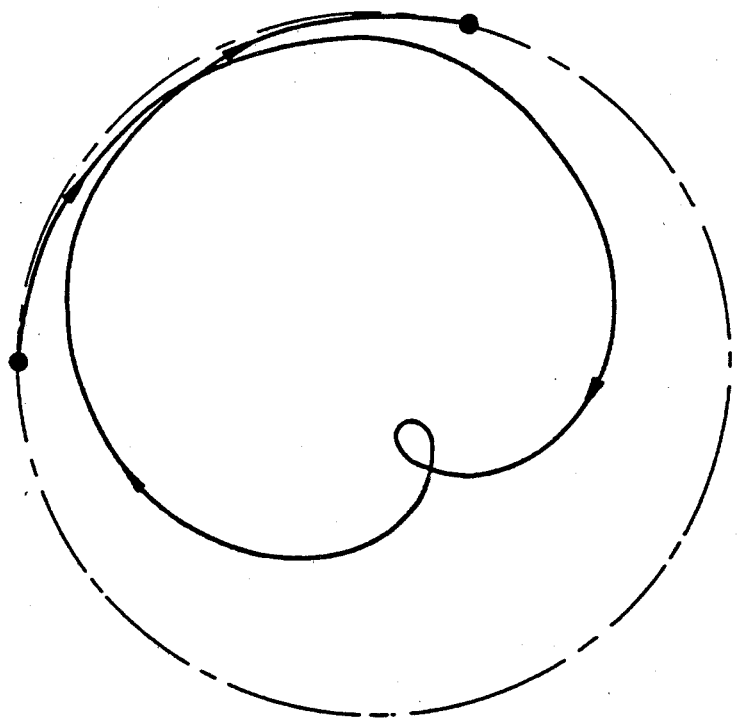
FIG. 6 shows the path of a point on a drum of the embodiment.
Figure 7:
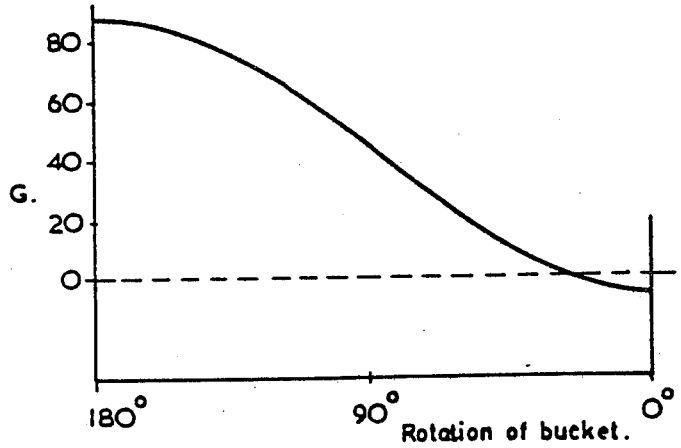
FIG. 7 shows the forces exerted on a particle in operation of the embodiment.

By subjecting the particles to repetitive acceleration of short duration, in the manner of a jig, by means of the apparatus of FIGS. 1 to 4, quite different results are obtained. In this example, the speed of rotation of the buckets 40 is set at 300 rpm and the speed of rotation of the buckets on their own axes at 190 rpm. The path of a particle under these conditions is shown in FIG. 6, and the forces, expressed in multiples of g, to which such a particle will be subjected relative to the opposed bucket surface, is shown in FIG. 7. It will be seen from this curve that both positive and negative g forces are applied to the particle relative to the internal surface, generated by the rotation of the central axis and the particular angular position of the surface about the second axis. Rotation about the second axis produces only positive g forces acting against the internal surface, and these forces serve to adjust the threshhold of negative "g".

In this way, the action of a conventional jig is simulated, but with much greater forces being generated.

The effect of this can be examined by substituting the inertial forces generated by the centrifugal jig, for the force of gravity in the known relationship for the distance travelled by a particle falling under the action of gravity with Newtonian resistance:

$$s = Av_m \ln \frac{2 + e^{t/A} + e^{-t/A}}{4}$$

in this equation, $v_m$ is the terminal velocity given by the following equation:

$$v_m = \sqrt{\frac{8}{3Q} g \frac{\Delta - \Delta'}{\Delta'} r}$$

t is the time, r the particle radius, Δ and Δ' the specific gravities of the particle and fluid, g the acceleration of gravity, all in c.g.s. units, and Q the coefficient of resistance.

Figure 8:
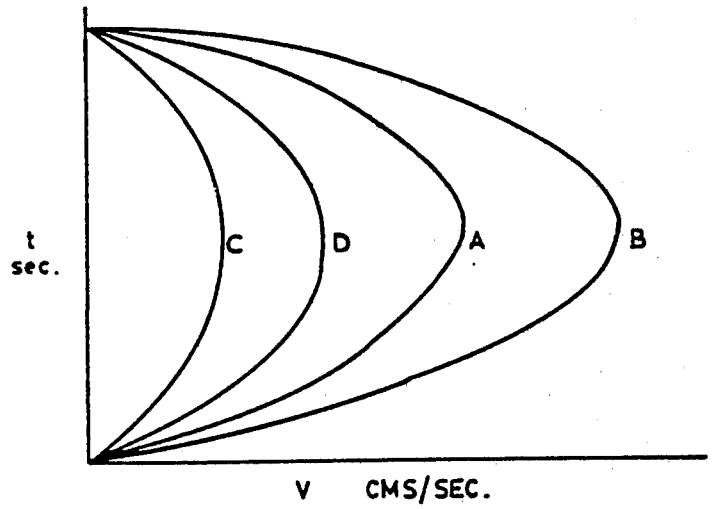
FIG. 8 shows curves of particle migration speed against time under repetitive high acceleration of orders produced in jigs according to the present invention.

By substituting the inertial forces for g, and considering typical parameters for the four particles which are the subject of the curves of FIG. 5, the curves of FIG. 8 show the distance travelled per second against time, for a cycle of acceleration in the jig.

As will be observed from FIG. 8, under conditions of repetitive acceleration the order of reporting of the particles is altered, the particles of large specific gravity and small size travelling further than the larger but less dense particles.

Thus at the periphery of the buckets 40, particularly in the region most remote from the axis of the machine, particles of highest specific gravity will be concentrated. It will have been observed that a small negative "g" force is generated, relative to the bucket wall, at the innermost location of the wall. This small negative acceleration is applied sufficient to arrest slurry movement without allowing significant cascading of the slurry towards the outer region of the bucket. It will be appreciated that the values of acceleration through the cycle are readily adjusted by varying the speed of the motors 22 and 39.

The tilting of the bucket axes from the vertical, apart from allowing the rotating masses involved with the bucket drive mechanism to be placed on minimum diameters, contributes significantly to the ease with which the high specific gravity particle faction may be separated.

The side wall of the buckets 40 is placed at such an angle to the bucket axis, that this wall slopes outwardly upwardly by a small angle at that part furthest from the jig axis. In this way the high specific gravity fraction will migrate upwardly in this region to be concentrated and pass outwardly through the slots 45.

The bulk of the slurry, replaced by incoming slurry, departs horizontally outwardly over the rim of the bucket 40, again in the region remote from the jig axis, where the flange 50 is horizontal. The flange 46 shrouds the slots 45 throughout this discharge region.

The residence time of slurry within the buckets 50 will be dictated by the angle of the bucket side wall and the speeds of rotation, and is adjusted for a given feed material to achieve the shortest residence time (and therefore greatest throughput) for which satisfactory separation is achieved.

Although the bucket wall angle is normally fixed for a given machine, and only alterable by substitution of buckets or bucket lining, the residence time or bucket angle may be made variable within reasonable limits by modification of the drive mechanism.

Not shown in the accompanying drawings, the chambers 47 and 51, provided for separate egress of the materials, are each provided with a helical guide which spans the chamber side walls and carries slurry and particles to the outlets, with the assistance of sprays mounted above the guide.

It will be observed that the vertical orientation of the machine illustrated, combined with the use of gravity and centrifugal feed of the slurry, obviates the need for any sealing arrangements in the slurry circuit. This is a great benefit in reducing the cost and maintenance requirements of the machine. Parts such as the buckets 40, feed pipes 42 and chambers 47 and 51 may be provided with a replaceable lining of suitable material such as polyurethane.

I claim:

1. Apparatus for the separation of particles in a slurry according to their specific gravity by subjecting said particles to repetitive acceleration, said apparatus comprising at least one chamber including a side wall surrounding a first axis, said chamber being mounted for rotation about said first axis and said first axis being mounted for rotation about a second axis, means for introducing slurry to said chamber, means for extracting from said chamber a fraction adjacent said side wall in a region of the side wall remote from said second axis, means for rotating the chamber about said first axis, and means for rotating the first axis about said second axis at a speed of rotation relative to the speed of rotation of the chamber about the first axis such that particles in the slurry are subjected to repetitive acceleration.

2. Apparatus according to claim 1 further characterised in that said second axis is vertical and said chamber is upwardly orientated.

3. Apparatus according to claim 2 further characterised in that said first axis intersects said second axis below said chamber.

4. Apparatus according to claim 3 further characterised in that a plurality of chambers is provided, each chamber comprising a bucket having a base and the side wall and being open at its upper end.

5. Apparatus according to claim 4 further characterised in that the side wall of each bucket, at the position remote from said second axis, extends upwardly and outwardly relative to said second axis.

6. Apparatus according to claim 4 further characterised in that each bucket is provided with a row of slots in its side wall below the upper edge thereof, said slots lying in a plane normal to said first axis and being dimensioned to pass particles of desired size from said slurry.

7. Apparatus according to claim 6 further characterised in that each said bucket is provided with a first peripheral flange surface extending outwardly and downwardly from the bucket side wall above said slots.

8. Apparatus according to claim 6 further characterised in that said bucket is provided with a second peripheral flange surface extending outwardly and, relative to said first axis, upwardly from the upper edge of said bucket.

9. Apparatus according to claim 8 further characterised in that said second flange surface is horizontally disposed at the position furthest from said second axis.

10. Apparatus according to claim 6 further characterised in that material passing through said slots is received by a first exit chamber defined between opposed walls surrounding said apparatus and guided thereby to a first outlet.

11. Apparatus according to claim 10, wherein slurry passing outwardly from each said bucket across the upper edge is received by a second exit chamber surrounding said first exit chamber, said slurry being conveyed by said second exit chamber to a second outlet.

12. A method of separating particles in a slurry according to their specific gravity comprising the steps of introducing said slurry continuously to a chamber rotating about its own axis and about a further axis, the relative speed of said rotations about said first and second axes being adjusted to produce repetitive acceleration of particles in said slurry, and continuously removing from said chamber a fraction immediately adjacent a side wall of said chamber in a region of the side wall most remote from said second axis.

13. A method of separating particles in a slurry according to their specific gravity, comprising the steps of introducing said slurry continuously to a chamber rotating about its own, substantially upright, axis and about a further, vertical axis, setting the relative speed of said rotations about the first and second axes to produce repetitive acceleration of said particles such that particles of greatest specific gravity are concentrated in a fraction immediately adjacent a side wall of said chamber in a region of the side wall most remote from said second axis, an selectively removing the said fraction from said chamber.

* * * * *